US005587035A

United States Patent [19]

Greene

[11] Patent Number: 5,587,035

[45] Date of Patent: Dec. 24, 1996

[54] COMPOSITE FILLED HOLLOW STRUCTURE

[76] Inventor: Robert H. Greene, 131 Stable Dr., Lancaster, Pa. 17603

[21] Appl. No.: 352,350

[22] Filed: Dec. 8, 1994

Related U.S. Application Data

[62] Division of Ser. No. 915,315, Jul. 20, 1992.

[51] Int. Cl.[6] ..... E04G 21/00

[52] U.S. Cl. ..... 156/187; 264/228; 264/257; 264/267; 264/333

[58] Field of Search ..... 106/772; 52/722, 52/723, 724, 725, 742.14; 264/228, 257, 258, 317, 333; 156/217, 187

[56] References Cited

U.S. PATENT DOCUMENTS 3,957,250 5/1976 Murphy ..... 256/19

4,157,263 6/1979 Gaines et al. ..... 106/89

*Primary Examiner*—James J. Seidleck
*Assistant Examiner*—Michael A. Williamson
*Attorney, Agent, or Firm*—Cushman Darby & Cushman, L.L.P.

[57] ABSTRACT

A filled hollow structure, such as a fence post, which is constructed with a hollow member filled with a core to increase its strength. One aspect of the structure is that the core material normal expands upon setting, so that, when hardening within the hollow member, the expansion is restrained by the hollow member and the core is formed into an integral structure with the hollow member. Further strength is added by constructing the hollow member of reinforced fiberglass with the fiberglass rovings oriented at an angle to the axis of the pipe and by using a hard coating on the outside of the pipe.

3 Claims, 1 Drawing Sheet

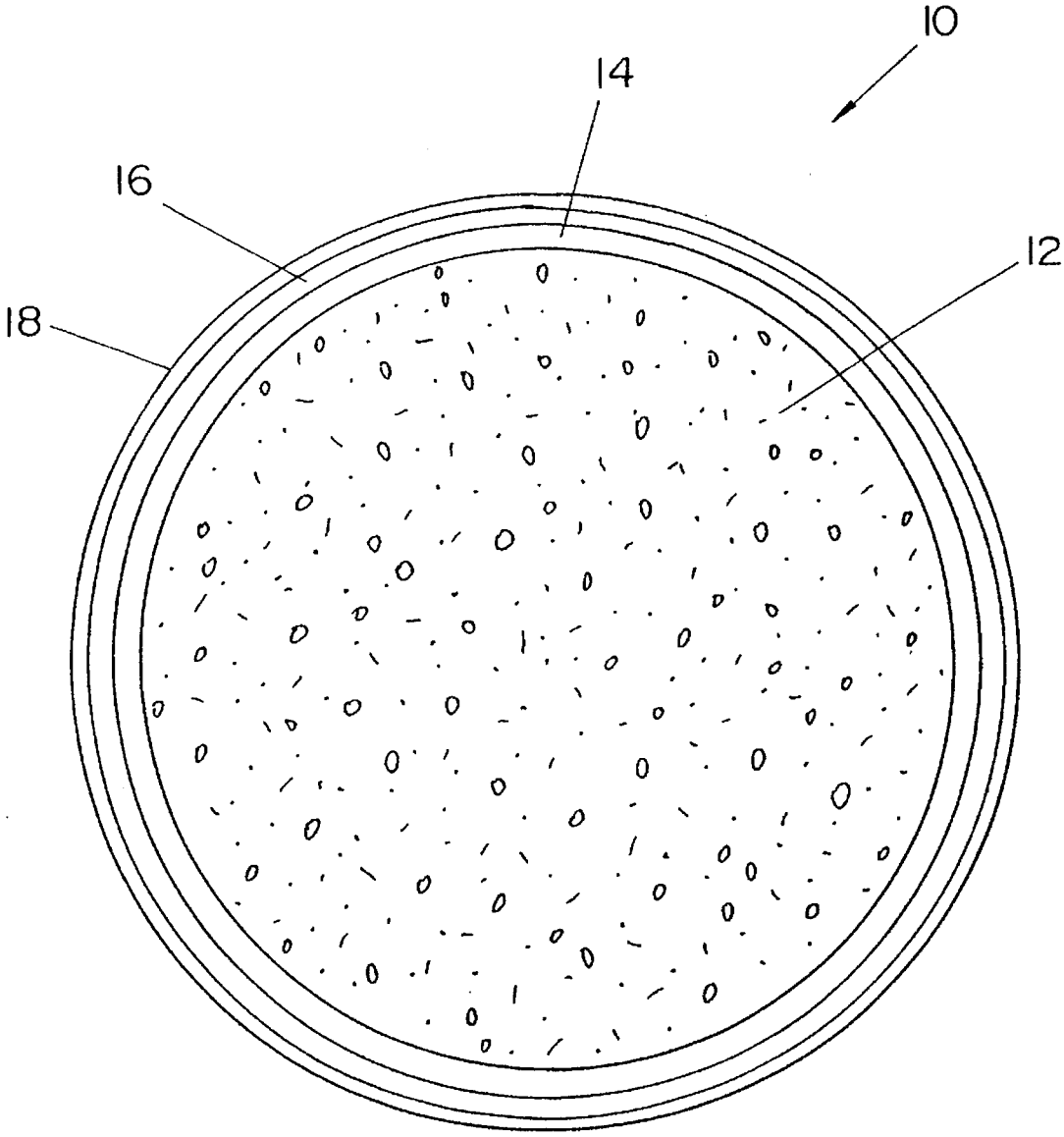
10
14
16
12
18

COMPOSITE FILLED HOLLOW STRUCTURE

This is a division of application Ser. No. 07/915,315 filed Jul. 20, 1992.

SUMMARY OF THE INVENTION

This invention deals generally with stock material, and more specifically with filled hollow structures such as light poles and fence posts and rails constructed of plastic or fiberglass.

The benefits of plastic and fiberglass for articles which are used where they are subject to corrosion are generally well recognized. Structures using such materials are light weight, strong, and attractive. They can be made with color integrated into the material so that they do not need frequent painting during their use, and possibly their greatest asset is the inherent chemical resistance of the materials. A fiberglass or plastic structure such as a fence post can be expected to last as long as anyone wants it to, even in the most severe environment, with no sign of deterioration, and it will not require any maintenance.

Unfortunately, the major limitation on the availability of such pole type fiberglass or plastic structures has been the cost and difficulty involved in their manufacture. One typical method of fiberglass construction is the forming of the fiberglass into a specific shape by wrapping multiple layers of fiberglass fabric on the outside of a core and impregnating the fabric with resin or epoxy, however such manufacturing methods are very expensive because they involve a great deal of hand labor.

Another approach, particularly to the construction of cylindrical structures, is to use preformed fiberglass or plastic pipe, However, such pole structures are not strong enough for most applications unless the pipe is very thick or the structure includes wood or metal reinforcing, and both of these approaches raise the cost of fiberglass and plastic poles so that they are not competitive with conventional metal poles.

One approach to reinforcing fiberglass or plastic pipe so it can be used as a structural member has been the use of fillers which are poured into the inside of the pipe, and then harden into a core. Fillers have been suggested which include wood with an adhesive binder (U.S. Pat. No. 4,602,765 by Loper) and rigid foam or concrete (U.S. Pat. No. 3,957,250 by Murphy), but these approaches do not furnish strength comparable to metal poles.

The present invention improves upon the technique of filling the interior of a hollow member to reinforce it by using a particular filler material mixture which produces a structure of greater strength by creating a stronger core and a superior bond to the exterior member. This is accomplished by selecting a material which normally expands while it is hardening, thereby forming a strong core with a stressed set and a force fit bond with the external member.

In the preferred embodiment of the invention, the material used for the core is a gypsum based structural material, but one which would expand as it is setting up except that it is restrained from expanding by the external member. The external member selected for the outside of the pole is selected to have a structural strength which is greater than the expansion force of the core structural material. Therefore, as the core material hardens, it forms a plug with a permanent positive stress and a higher than usual density within the external member, and this plug is locked tightly within and virtually bonded to the external member.

In effect, a compression stressed core member is formed within and integrated with the external member, and this gives the filled hollow structure greater strength than would result from a core material which does not expand upon hardening, because a core made of such a non-expanding material could slide within the external member at the boundary between the external member and the core. To derive the full benefit of the filled hollow structure, the core material must also have great enough structural strength to add significantly to the strength of the finished structure.

An additional benefit of the structure of the preferred embodiment is that the external member protects the core material from any environmental factors which might otherwise cause the core material to deteriorate with exposure.

Two other techniques are also used to increase the strength of the filled hollow structure. One, which is available only for structures which include fiberglass in the external hollow member, involves the specific orientation of the rovings of the fiberglass used in the external member. When the external member is constructed so that the fiberglass rovings in it are essentially angled to the axis of the external member, it has greater resistance to splitting than does a structure in which the rovings are essentially aligned with the axis or perpendicular to the axis. While this increase in strength is not sufficient to permit the use of an external member without a strengthened core, it is a beneficial safety factor for a structure which is already within the required range of strength.

Another benefit can be secured from the selection of a proper veil coating on the outside surface of the external member. Such veil coatings are often used to protect fiberglass reinforced products from deterioration caused by exposure to ultraviolet rays, but the veil coating, in the proper thicknesses, can also add some structural strength to the structure.

A final additional coating can also be added to the pole structure of the present invention to add particular surface finishes and additional ultraviolet protection. This coating also adds to the strength of the finished composite structure.

The present invention therefore furnishes a highly desirable improvement for fiberglass and plastic filled hollow structures which makes them practical to use for such common and cost sensitive applications as light poles and fence posts and rails, since they can now be competitive with metal poles.

BRIEF DESCRIPTION OF THE DRAWING

The FIGURE is an end view across the axis of the preferred, embodiment of the invention.

DETAILED DESCRIPTION OF THE INVENTION

The FIGURE shows an end view across the axis of pole 10 of the preferred embodiment. Pole 10 is formed of four distinct materials, one of which, core 12, takes on a particular significance because of the manner in which it is formed. Core 12 is encased within pipe 14 which is covered by veil 16, on top of which is placed protective surface coating. Each of the four parts of composite pole structure 10 adds a particular characteristic to the pole structure, and together they furnish a pole of superior strength which can be produced economically.

The construction of pole 10 is essentially based upon the filling of pipe 14 with core 12, but core 12 has unique properties which produce a non-metallic pole with strength equivalent to that of steel poles. Core 12 is a gypsum based product with the important characteristic of normally expanding as it hardens. It is important that the core material normally expand in order that it have a permanent positive stress and produce a force fit with exterior pipe 14. It is also vital that the hardened core have significant strength, which is best indicated by a compressive strength rating of at least 1500 psi, so that it adds significant strength to the structure and does not act to merely fill the interior space of the pipe. The structural strength of the hardened core must, however, be less than the structural strength of pipe 14 in order to prevent the forces produced by the attempted expansion during hardening of core 12 from distorting and weakening pipe 14 as it restrains the expansion of core 12.

In the preferred embodiment, cylindrical pipe 14 has a two inch outer diameter with 0.080 inch wall thickness and is constructed with a standard isothalic polyester resin base reinforced with fiberglass rovings throughout its entire thickness. Such a material has a tensile strength of at least 30,000 psi. Added bending strength can be attained if the significant portion of the fiberglass rovings are oriented to be at an angle of approximately 45 degrees to the axis of the pole.

As with all fiberglass and resin structures, color pigments may be added during manufacture of pipe 14 to produce consistent color throughout the entire pipe.

It is also advantageous to produce veil 16 on the exterior surface of pipe 14 when it is being manufactured. Veil 16 is a layer of polyester cloth impregnated with resin. The production of such a veil is well understood by those skilled in the art of fiberglass construction. Veil 16 protects the fiberglass against ultraviolet radiation, protects against blooming of the surface fibers of the fiberglass and also adds strength to pole 10.

Core 12 is composed of a mixture of sand, water and a gypsum based material. In the preferred embodiment the specific material used is an alpha hemihydrate such as "Super X Hydro Stone" manufactured by U.S. Gypsum. This material is gypsum in calcinated, dehydrated, crystallized, powder form. One particular mixture used in the preferred embodiment has 100 parts "Hydro Stone", 24 parts water and 200 parts 00 silica sand.

When hardened this formula yields a compressive strength of 6000–9000 psi, but still has enough flexibility to permit bending of pole 10. Moreover, this particular formula normally expands about 0.1 percent upon hardening, and therefore provides an exceptionally strong force fit with pipe 14. The density of such a core is at least 35 pounds per cubic foot.

Protective coating 18 may also be added to pole 10, for the purpose of enhancing ultraviolet protection and corrosion resistance and to produce a smooth surface. Such a coating is referred to as a "hard coat" in industry terminology, and is well understood by those skilled in coating technology. It is applied during the manufacture of the pipe and is at least 0.001 inch thick. Protective coating 18 is clear, can be made with or without pigments, has a medium gloss finish, and includes specific ultraviolet absorbers.

The composite pole of the present invention furnishes bending strength equal to or greater than Schedule 40 steel pipe (ASTM F-1083) of the same diameter, and its inherent corrosion resistance is far superior to that of steel. Moreover, the present invention actually furnishes a pole which will flex more than twice as far as steel and still return to its original shape without failure.

It is to be understood that the form of this invention as shown is merely a preferred embodiment. Various changes may be made in the function and arrangement of parts; equivalent means may be substituted for those illustrated and described; and certain features may be used independently from others without departing from the spirit and scope of the invention as defined in the following claims.

For instance, structures may be produced without either veil 14 or protective coating 16 when the application does not require ultraviolet protection. Moreover, the diameter and cross sectional configuration of the external member may, of course, vary, and the particular formula of the core could be changed as long as the requirements of the claims are retained.

What is claimed as new and for which Letters Patent of the United States are desired to be secured is:

1. A method of constructing a filled structure characterized by the combination of high compressive strength and tensile strength to allow a high bending load comprising:

providing a fiber reinforced resinous hollow structure having a tensile strength of at least 30,000 psi and an inside surface forming a boundary which encloses a space, providing a mixture of particulate cementitious material and liquid which may be hardened into a hard core, said mixture being selected so that the hard core formed therefrom has a density of at least 35 pounds per cubic foot and a compressive strength of at least 1500 psi and the mixture expands its volume as it hardens, placing the mixture within the space, and permitting said mixture to expand and harden into the hard core within the hollow structure in such a manner that expansion of the mixture is restrained by the hollow structure and the hard core exerts a force against the inside surface of the hollow structure such that the hard core is force-fit against the inside surface to provide said filled structure.

2. The method of constructing a filled structure of claim 1 further including attaching a veil on the outside of the hollow structure with the veil comprising a cloth material impregnated with resin.

3. The method of constructing a filled structure of claim 1 further including attaching a coating on the outside of the hallow structure with the coating comprising a material which absorbs ultraviolet radiation.

* * * * *